US008285161B2

(12) United States Patent
Furukawa et al.

(10) Patent No.: US 8,285,161 B2
(45) Date of Patent: Oct. 9, 2012

(54) IMAGE FORMING APPARATUS OPERABLE IN MONOCHROME AND COLOR PRINTING MODES

(75) Inventors: Toshio Furukawa, Aichi (JP); Kensuke Miyahara, Hekinan (JP); Yoh Nishimura, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 390 days.

(21) Appl. No.: 12/731,164

(22) Filed: Mar. 25, 2010

(65) Prior Publication Data

US 2010/0303492 A1 Dec. 2, 2010

(30) Foreign Application Priority Data

May 29, 2009 (JP) ..... 2009-131045
May 29, 2009 (JP) ..... 2009-131046

(51) Int. Cl.
*G03G 15/01* (2006.01)

(52) U.S. Cl. ..... 399/54; 399/228; 399/302

(58) Field of Classification Search ..... 399/50, 399/54, 55, 66, 223, 228, 298, 299, 302
See application file for complete search history.

(56) References Cited

U.S. PATENT DOCUMENTS 6,385,427 B1 * 5/2002 Nakane ..... 399/303
6,553,192 B2 * 4/2003 Maebashi ..... 399/50
7,050,733 B2 * 5/2006 Saito et al. ..... 399/55
7,058,326 B2 * 6/2006 Toyama ..... 399/50
7,130,552 B2 * 10/2006 Nishida et al. ..... 399/66
2002/0154924 A1 * 10/2002 Takahashi et al. ..... 399/303
2008/0317506 A1 12/2008 Furukawa
2011/0318028 A1 * 12/2011 Miyahara et al. ..... 399/44

FOREIGN PATENT DOCUMENTS

JP 63183463 A * 7/1988
JP 02046473 A * 2/1990
JP 02056566 A * 2/1990
JP 03256068 A * 11/1991
JP 06-075484 3/1994
JP 08063052 A * 3/1996
JP 2001125399 5/2001
JP 2001125457 5/2001
JP 2007140121 A * 6/2007
JP 2008-116827 5/2008
JP 2008197464 A * 8/2008
JP 2009-003377 1/2009

* cited by examiner

*Primary Examiner* — Robert Beatty
(74) *Attorney, Agent, or Firm* — Banner & Witcoff, Ltd.

(57) ABSTRACT

In an image forming apparatus, a first photoconductor drum for use in at least in a monochrome printing mode is located upstream, in a direction of transport of a medium, of a plurality of second photoconductor drums for use in a color printing mode. A transfer bias for each of transfer members is regulated in such a manner that a transfer bias applied in the monochrome printing mode between a second photoconductor drum located adjacently downstream of the first photoconductor drum and the corresponding transfer member is larger than that applied in the color printing mode. A developing bias for each of the development rollers is regulated in such a manner that an absolute value of a developing bias voltage applied to a development roller corresponding to the first photoconductor drum in the monochrome printing mode is smaller than that applied in the color printing mode.

5 Claims, 6 Drawing Sheets

TRANSFER CURRENT IN COLOR PRINTING MODE

| K | Y | M | C |
|---|---|---|---|
| 10μA | 8μA | 10μA | 10μA |

TRANSFER CURRENT IN MONOCHROME PRINTING MODE

| K | Y | M | C |
|---|---|---|---|
| 8μA | 20μA | 5μA | 5μA |

FIG. 4A

TRANSFER CURRENT IN COLOR PRINTING MODE

| K | Y | M | C |
|---|---|---|---|
| 10μA | 8μA | 10μA | 10μA |

FIG. 4B

TRANSFER CURRENT IN MONOCHROME PRINTING MODE

| K | Y | M | C |
|---|---|---|---|
| 8μA | 20μA | 5μA | 5μA |

FIG. 5

| | DEVELOPING BIAS VOLTAGE | SURFACE POTENTIAL OF PHOTOCONDUCTOR DRUM (AFTER EXPOSURE TO LIGHT) |
|---|---|---|
| COLOR PRINTING MODE | 450V | 700V(150V) |
| MONOCHROME PRINTING MODE | 300V | 550V(150V) |

IMAGE FORMING APPARATUS OPERABLE IN MONOCHROME AND COLOR PRINTING MODES

CROSS-REFERENCE TO RELATED APPLICATION(S)

This application claims priority from Japanese Patent Application Nos. 2009-131045 and 2009-131046, filed on May 29, 2009, the disclosure of which is incorporated herein by reference in its entirety.

BACKGROUND OF THE INVENTION

1. Field of the Invention

The present invention relates to an image forming apparatus operable in a plurality of operation modes including a monochrome printing mode and a color printing mode.

2. Description of Related Art

In an electrophotographic color image forming apparatus, a plurality of units, each of which includes a photoconductor drum, a development roller, a transfer roller and other components, are provided for a plurality of colors, and supplied with toner of corresponding colors to form a toner image of each color one after another on an intermediate transfer belt or a recording sheet being transported. In the following description, the intermediate transfer belt and the recording sheet are collectively referred to as "transfer medium" or "medium" where appropriate.

To do monochrome printing in the color image forming apparatus, no toner other than the toner in monochrome (typically in black) is required, and thus development devices provided for the other colors may be put out of operation, for example, by separating the development rollers from the corresponding photoconductor drums so that degradation of the toner of these other colors are reduced.

On the other hand, generally speaking, not all the toner on the surfaces of the photoconductor drums will be transferred from the photoconductor drums to the transfer medium, and some toner may remain on the surfaces of the photoconductor drums. Thus, it would be desirable to remove the remaining toner. For that purpose, a cleaning unit having a blade and/or a roller may be provided, as is often the case. Alternatively, a method of collecting the remaining toner on the photoconductor drums by the development rollers and remixing the collected toner back into the toner in the development devices may be adopted. This type of cleaning method is sometimes called "cleanerless" method.

However, if the cleanerless method could be adopted in the image forming apparatus configured to separate the development rollers from the corresponding photoconductor drums except the photoconductor drum used in monochrome printing during the monochrome printing, the toner supplied for the monochrome printing, transferred to the transfer medium during the monochrome printing and adhered ("reversely transferred") to the photoconductor drums located downstream of the photoconductor drum for the monochrome printing would not be collected by the development rollers separated from the corresponding photoconductor drums. This would disadvantageously produce a ghost image derived from the retransfer to the transfer medium, of the reversely transferred toner image on the photoconductor drum.

Thus, there is a need to reduce the possibility of formation of a ghost image in an image forming apparatus adopting a cleanerless method and operable in a monochrome printing mode in which the development rollers are separated from the corresponding photoconductor drums other than that to be used for the monochrome printing.

The present invention has been made in an attempt to address the aforementioned problem in prior art.

SUMMARY OF THE INVENTION

It is one aspect of the present invention to provide an image forming apparatus in which the "reverse transfer" of developer in the monochrome printing mode can be reduced and/or in which the possibility of formation of a ghost image can be reduced.

More specifically, in one aspect of the present invention, an image forming apparatus operable in a plurality of operation modes including a monochrome printing mode and a color printing mode is provided. The image forming apparatus comprises: a first photoconductor drum for use at least in the monochrome printing mode; a plurality of second photoconductor drums for use in the color printing mode; a plurality of development rollers disposed in positions corresponding to the first and second photoconductor drums, each of the development rollers being configured to be in contact with and supply a corresponding photoconductor drum with developer and operative to collect the developer remaining on the corresponding photoconductor drum in contact therewith during an operation thereof; a separation mechanism configured to cause the development rollers corresponding to the second photoconductor drums to move away from the corresponding second photoconductor drums and to come back to the positions in which the development rollers are in contact with the corresponding second photoconductor drums; a plurality of transfer members disposed in positions corresponding to the first and second photoconductor drums to transfer the developer from the surfaces of the photoconductor drums to a medium being transported, wherein the second photoconductor drums are located downstream of the first photoconductor drum in a direction of transport of the medium; and a controller which comprises a separation mechanism control unit configured to exercise control over the separation mechanism such that the development rollers corresponding to the second photoconductor drums are away from the corresponding second photoconductor drums in the monochrome printing mode.

In one embodiment, the controller further comprises a transfer bias regulator configured to regulate a transfer bias for each of the transfer members in such a manner that a transfer bias applied in the monochrome printing mode between a second photoconductor drum located adjacently downstream of the first photoconductor drum in the direction of transport of the medium and the corresponding transfer member is larger than that applied in the color printing mode.

In another embodiment, the apparatus further comprises a plurality of chargers disposed in positions corresponding to the first and second photoconductor drums to electrically charge surfaces of the photoconductor drums, and the controller further comprises a developing bias regulator configured to regulate a developing bias for each of the development rollers in such a manner that an absolute value of a developing bias voltage applied to a development roller corresponding to the first photoconductor drum in the monochrome printing mode is smaller than that applied in the color printing mode, and a photoconductor potential regulator configured to regulate a surface potential of each of the photoconductor drums by controlling a corresponding charger in such a manner that an absolute value of the surface potential of the first photoconductor drum in the monochrome mode is smaller than that in the color printing mode.

BRIEF DESCRIPTION OF THE DRAWINGS

The above aspect, other advantages and further features of the present invention will become more apparent by describing in detail illustrative, non-limiting embodiments thereof with reference to the accompanying drawings, in which:

FIG. 4A is a table showing transfer currents in a color printing mode;

FIG. 4B is a table showing transfer currents in a monochrome printing mode;

FIG. 5 is a table showing surface potentials of a photoconductor drum to be supplied with toner in black (color for monochrome printing) and developing bias voltages applied to a development roller corresponding thereto, in a color printing mode and in a monochrome printing mode;

DETAILED DESCRIPTION OF THE EXEMPLARY EMBODIMENTS

Figure 1:
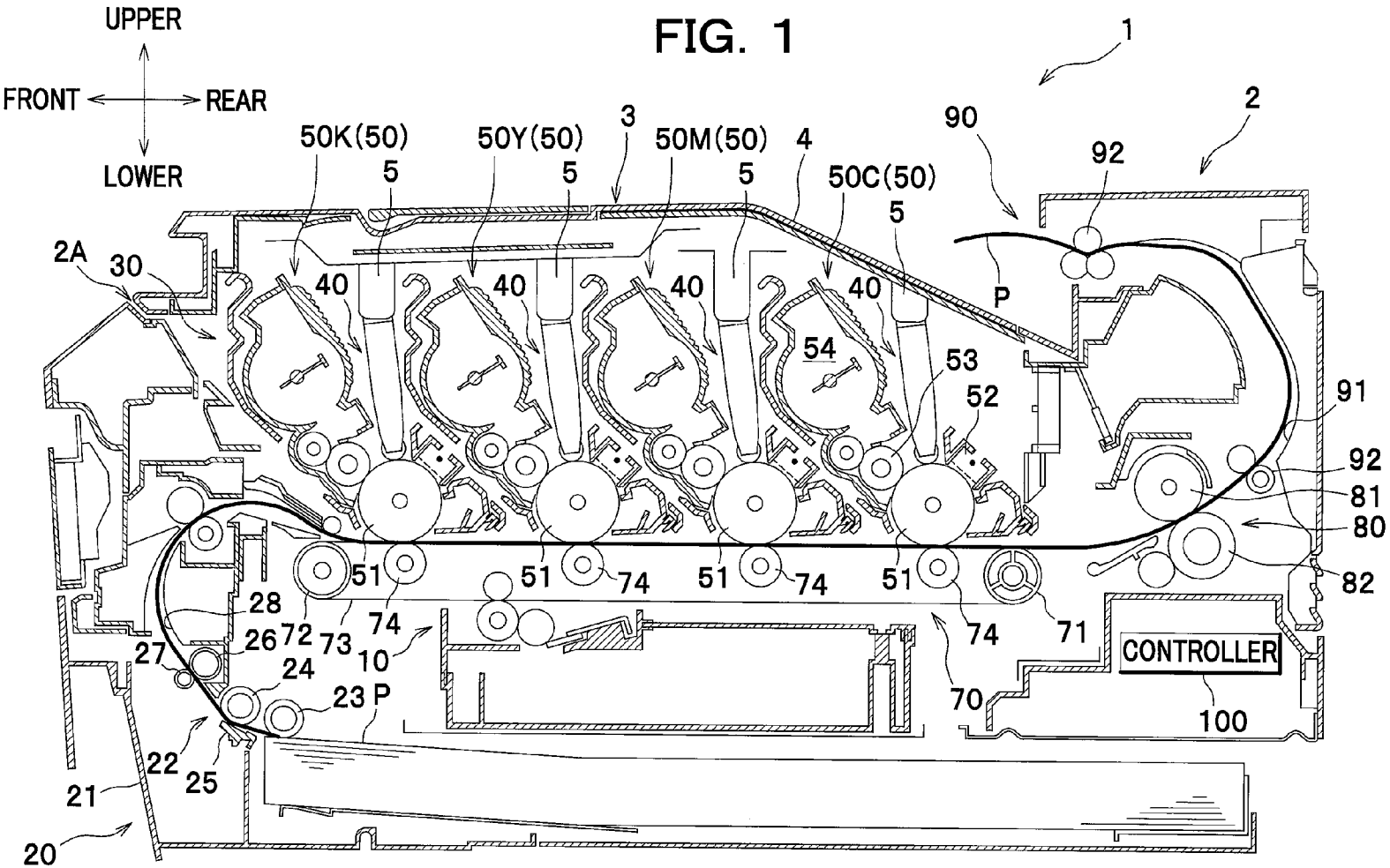
FIG. 1 is a vertical section of a color printer as an example of an image forming apparatus according to an exemplary embodiment of the present invention.

A detailed description will be given of exemplary embodiments of the present invention with reference to the drawings. In the following description, the direction is designated as from the viewpoint of a user who is using (operating) a color printer (image-forming apparatus). To be more specific, in FIG. 1, the left-hand side of the drawing sheet corresponds to the "front" side of the printer, the right-hand side of the drawing sheet corresponds to the "rear" side of the printer, the back side of the drawing sheet corresponds to the "left" side of the printer, and the front side of the drawing sheet corresponds to the "right" side of the printer. Similarly, the direction of a line extending from top to bottom of the drawing sheet corresponds to the "vertical" or "up/down (upper/lower or top/bottom)" direction of the printer.

<General Setup of Laser Printer>

At the outset, a general setup of a color printer as an example of an image forming apparatus according to an exemplary embodiment of the present invention will be described with reference to FIG. 1.

As shown in FIG. 1, a color printer 1 comprises a body casing 2, and other components housed within the body casing 2 which principally include a sheet feeder unit 20 for feeding a sheet P (e.g., of paper) as one example of a recording sheet, an image forming unit 30 for forming an image on the sheet P fed by the sheet feeder unit 20, a sheet output unit 90 for ejecting the sheet on which an image has been formed by the image forming unit 30, and a controller 100.

At an upper portion of the body casing 2, an opening 2A is provided. The opening 2A is openably closed by an upper cover 3 that is swingably supported by the body casing 2. An upper surface of the upper cover 3 is designed to constitute a sheet output tray 4 on which sheets P ejected from inside of the body casing 2 are stacked and accumulated. At a lower surface of the upper cover 3, a plurality of LED mount members 5 for holding LED units 40 are provided.

The sheet feeder unit 20, provided in a lower space within the body casing 2, principally includes a sheet feed tray 21 removably installed in the body casing 2, and a sheet feed mechanism 22 for feeding a sheet P from the sheet feed tray 21 to the image forming unit 30. The sheet feed mechanism 22, provided frontwardly of the sheet feed tray 21, principally includes a sheet feed roller 23, a separation roller 24 and a separation pad 25.

In the sheet feeder unit 20 configured as described above, sheets P in the sheet feed tray 21 are separated and fed upward one after another by the sheet feed mechanism 22. Each sheet P thus fed upward is passed through between a paper powder remover roller 26 and a pinch roller 27 so that paper powder is removed from each sheet P. Thereafter, the sheet P is conveyed through a sheet conveyance path 28 in which a direction of conveyance of the sheet P is changed to the rearward, so that the sheet P is provided into the image forming unit 30.

The image forming unit 30 principally includes four LED units 40, four process cartridges 50, a transfer unit 70, a cleaning unit 10 and a fixing unit 80.

Each of the LED units 40 is swingably coupled to an LED mount member 5, located in place and held by a positioning member provided in the body casing 2.

The process cartridges 50 are disposed between the upper cover 3 and the sheet feeder unit 20 within the body casing 2 and arranged in tandem, in the front-rear direction. Each of the process cartridges 50 principally includes a photoconductor drum 51 on which an electrostatic latent image is formed, a charger 52, a development roller 53, and a toner reservoir 54 which contains toner as one example of a developer.

The process cartridges 50, of which toner reservoirs 54 contain toner in black, yellow, magenta and cyan, are designated by reference characters 50K, 50Y, 50M and 50C, respectively, and arranged in this order from upstream to downstream with respect to the direction of transport of the sheet P. In the following description, and drawing figures as will be referred to, of this application, the photoconductor drums 51, chargers 52, development rollers 53 and transfer rollers 74 for respective colors (black, yellow, magenta and cyan) of toner will be designated by specific reference characters with suffixes of K, Y, M and C added to the relevant numerals 51, 52, 53 and 74.

Figure 2:
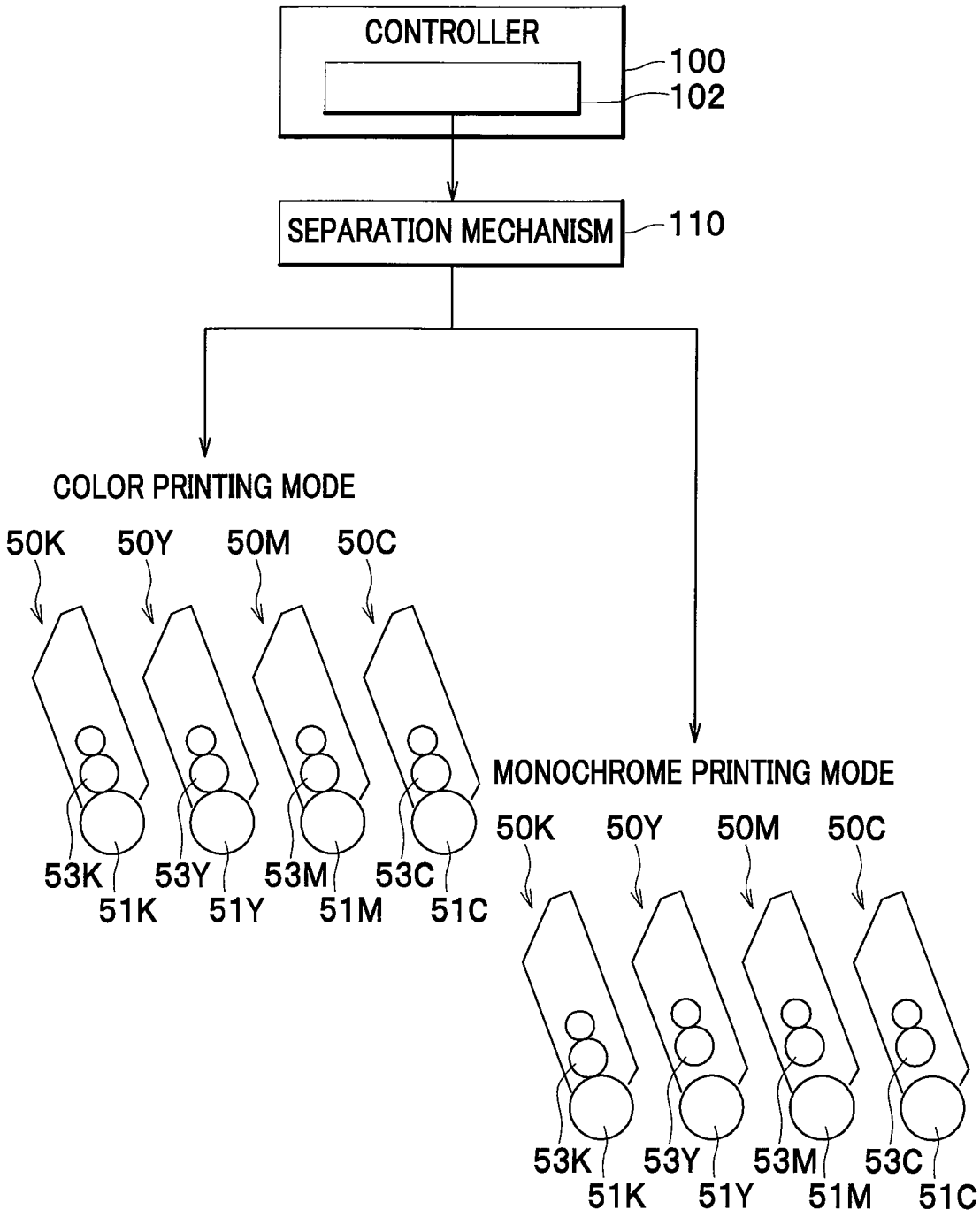
FIG. 2 is a schematic diagram illustrating separation of development rollers from photoconductor drums.
Figure 3:
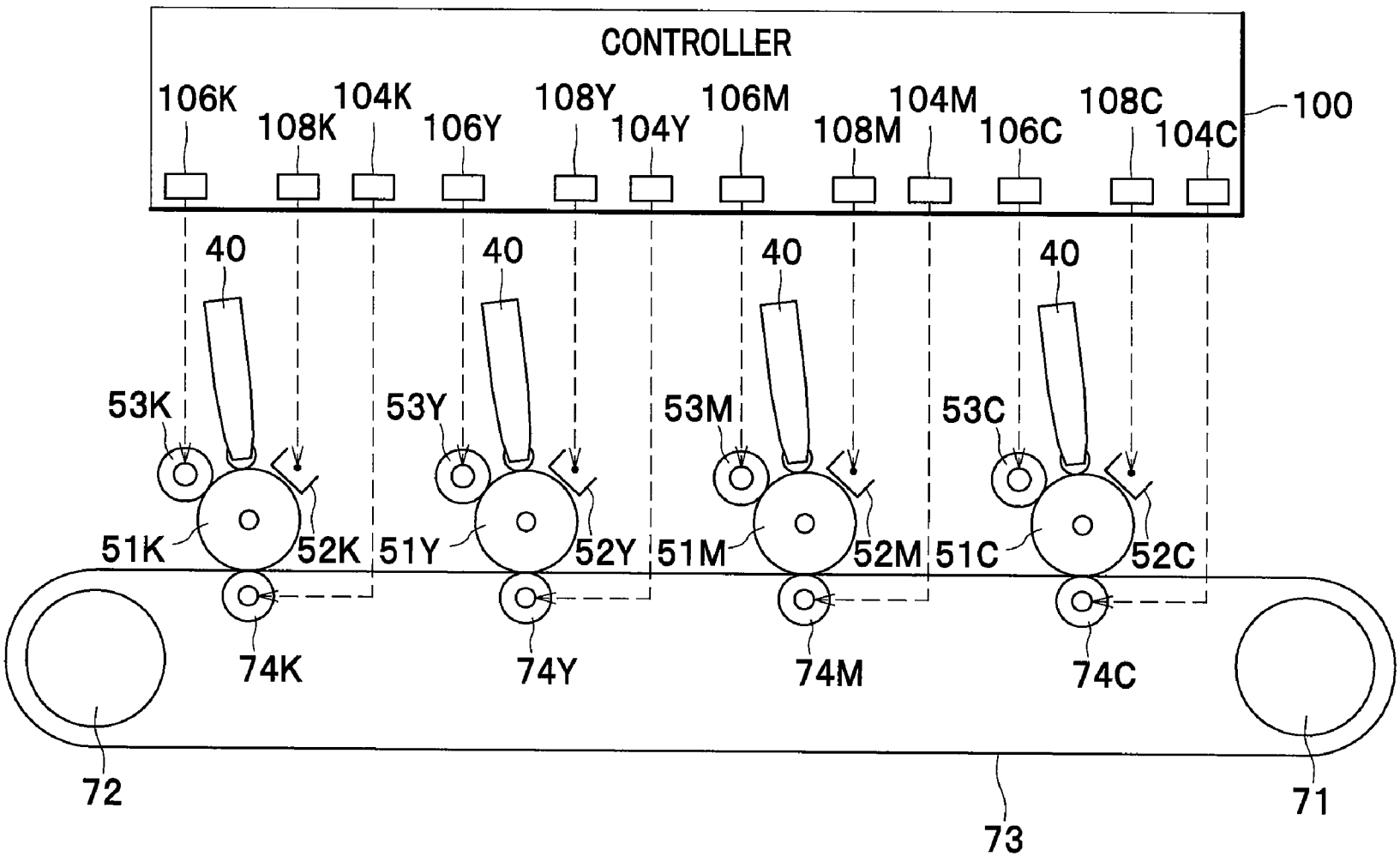
FIG. 3 is a schematic diagram illustrating application of voltages to the development rollers, chargers and transfer rollers under control of a controller.

The photoconductor drums 51 include, as shown in FIGS. 2 and 3, four photoconductor drums 51K, 51Y, 51M and 51C corresponding to the four colors of toner, among which the photoconductor drum 51K serves as an example of a first photoconductor drum, and the photoconductor drums 51Y, 51M and 51C serve as one example of second photoconductor drums in the present embodiment.

The development rollers 53 include, as shown in FIGS. 2 and 3, four development rollers 53K, 53Y, 53M and 53C corresponding to the four colors of toner. As shown in FIG. 2, the development rollers 53 are configured to be selectively separated from the corresponding photoconductor drums 51 by a separation mechanism 110 which may be configured as known in the art (e.g., a mechanism similar to a switching mechanism disclosed in JP 2009-3377 A) under control of the controller 100 (a separation mechanism control unit 102 provided in the controller 100). To be more specific, when color printing is done (i.e., the operation mode which will be described later is set in a color printing mode), all the development rollers 53K, 53Y, 53M and 53C are in contact with the corresponding photoconductor drums 51K, 51Y, 51M and 51C to supply these photoconductor drums 51K, 51Y, 51M and 51C with toner of corresponding colors. On the other hand, when monochrome printing is done (i.e., the operation mode is set in a monochrome printing mode), the development roller 53K for black only is in contact with the corresponding photoconductor drum 51K, while the other development rollers 53Y, 53M and 53C are in positions separate from the corresponding photoconductor drums 51Y, 51M and 51C.

The transfer unit 70 is disposed between the sheet feeder unit 20 and the process cartridges 50. The transfer unit 70 principally includes a driving roller 71, a driven roller 72, a conveyor belt 73, and transfer rollers 74 as one example of transfer members.

The driving roller 71 and the driven roller 72 are disposed parallel to each other and separate from each other in the front-rear direction. The conveyor belt 73 is an endless belt looped around the driving roller 71 and the driven roller 72. The conveyor belt 73 has an outer surface in contact with each of the photoconductor drums 51. Four transfer rollers 74 are disposed inside the conveyor belt 73 in positions opposite to the corresponding photoconductor drums 51 so that the conveyor belt 73 is held between the transfer rollers 74 and the corresponding photoconductor drums 51. A transfer bias is applied to each of the transfer rollers 74 under a constant-current regulating control scheme during a transfer operation.

The fixing unit 80 is disposed rearward of the process cartridges 50 and the transfer unit 70. The fixing unit 80 principally includes a heating roller 81, and a pressure roller 82 disposed opposite to the heating roller 81 and configured to be pressed against the heating roller 81.

Operation in the image forming unit 30 configured as described above, with its operation mode set in a color printing mode is as follows. First, the surface of each photoconductor drum 51 is uniformly charged by the charger 52, and then exposed to light directed from the corresponding LED unit 40. Thereby, an electric potential of exposed portions is lowered so that an electrostatic latent image based upon image data is formed on the surface of each photoconductor drum 51. Thereafter, toner is supplied from the development roller 53 to the surface of the photoconductor drum 51, and thus a toner image is formed and retained on the surface of the photoconductor drum 51 where the electrostatic latent image is formed.

When a sheet P fed onto the conveyor belt 73 is held and passed through between each photoconductor drum 51 and the corresponding transfer roller 74, the toner image formed on the surface of the photoconductor drum 51 is transferred onto the sheet P. The sheet P is then passed through between the heating roller 81 and the pressure roller 82 in the fixing unit 80, whereby the toner image transferred on the sheet P is fixed by heat.

The sheet output unit 90 principally includes an output-side sheet conveyance path 91 extending from an outlet of the fixing unit 80 upward and gently turning frontward, and a plurality of pairs of conveyor rollers 92 configured to convey the sheet P along the output-side sheet conveyance path 91. The sheet P on which a toner image is transferred and thermally fixed is conveyed by the conveyor rollers 92 through the output-side sheet conveyance path 91, and ejected out of the body casing 2 and accumulated on the sheet output tray 4.

The controller 100 comprises a central processing unit or CPU, a read-only memory or ROM, a random-access memory or RAM, which operate in accordance with programs provided in advance, and is configured to receive printing data and to exercise control over the sheet feeder unit 20, the image forming unit 30, the sheet output unit 90 and the separation unit 110.

In the present embodiment, as shown in FIGS. 2 and 3, the controller 100 comprises several modules such as the separation mechanism control unit 102 configured to exercise control over the separation mechanism 110, transfer bias regulators 104 (104K, 104Y, 104M and 104C) configured to regulate transfer biases for the transfer rollers 74 (74K, 74Y, 74M and 74C), respectively, developing bias regulators 106 (106K, 106Y, 106M and 106C) configured to regulate developing biases for the development rollers 53 (53K, 53Y, 53M and 53C), respectively, and photoconductor potential regulators 108 (108K, 108Y, 108M and 108C) configured to regulate surface potentials of the photoconductor drums 51 (51K, 51Y, 51M and 51C), respectively. The surface potential of each photoconductor drum 51 (51K, 51Y, 51M or 51C) may be regulated by controlling the corresponding charger 52 (52K, 52Y, 52M or 52C).

<Transfer Bias Regulation Control>

The next discussion focuses on a transfer bias to be applied to each transfer roller 74, and more specifically on the transfer bias regulated under control of the controller 100 (the transfer bias regulator 104 provided in the controller 100).

In the following description of the present embodiment, positively chargeable toner is used by way of example, but negatively chargeable toner may be used instead. The polarity of the transfer bias may be appropriately set in accordance with the charging polarity of the toner used.

The transfer bias is a voltage to be applied between each photoconductor drum 51 and the corresponding transfer roller 74 to transfer a toner image on the photoconductor drum 51 onto a sheet P being conveyed on the conveyor belt 73. In the present embodiment, the transfer bias is regulated under a constant-current regulating control scheme such that a transfer current (an electric current flowing through each photoconductor drum 51 and the corresponding transfer roller 74) remains constant. It is however understood that the transfer bias may alternatively be regulated under a constant-voltage regulating control scheme.

When color printing is done, with the operation mode set at a color printing mode, the transfer current for each transfer roller 74 is regulated at a constant current of: 10 μA for toner in black (K), 8 μA for toner in yellow (Y), 10 μA for toner in magenta (M) and 10 μA for toner in cyan (C), as shown in FIG. 4A. These values are target values of electric current selected with consideration given comprehensively to several factors such as the chargeability of toner in each color and the chromogenic quality of each color after printing. Under the constant-current regulating control scheme, normally, the potential difference applied between each photoconductor drum 51 and the corresponding transfer roller 74 should be large enough to maintain a high amperage of electric current. It is thus to be understood that the potential difference between each photoconductor drum 51 and the corresponding transfer roller 74 corresponds substantially to the target value of electric current determined exemplarily for each color as shown in FIG. 4A.

When monochrome printing is done, with the operation mode set at a monochrome printing mode, the transfer current for each transfer roller 74 is regulated at a constant current of: 8 μA for toner in black (K), 20 μA for toner in yellow (Y), 5 μA for toner in magenta (M) and 5 μA for toner in cyan (C), as shown in FIG. 4B. In this way, the transfer bias to be applied to the transfer roller 74Y for toner in yellow (next to the transfer roller 74K for toner in black) in the monochrome printing mode is larger than that applied thereto in the color printing mode, whereas the transfer biases to be applied to the transfer rollers 74M and 74C for toner in magenta and cyan (the third and fourth counting from the transfer roller 74K for toner in black) are smaller than that applied thereto in the color printing mode.

There are several reasons:

(1) the transfer bias for the photoconductor drum 51Y for toner in yellow next to the photoconductor drum 51K for toner in black (monochrome) is made larger in the monochrome printing mode because toner particles of low chargeability are likely to be reversely transferred to the adjacently located photoconductor drum 51Y and thus an electric field attracting charges from the photoconductor drum 51Y to the transfer roller 74Y is increased to a degree enough to reduce such reverse transfer.

(2) if the transfer biases for all the photoconductor drums 51Y, 51M and 51C for toner in yellow, magenta and cyan, located downstream of the photoconductor drum 51K for toner in black would be made larger in the monochrome printing mode, toner particles would be likely to be charged more and more each time the toner particles pass through between the photoconductor drum 51 and the corresponding transfer roller 74 (so-called "charge up"), and the excessive charges would cause discharge between the toner particles and between the toner and the sheet P, with the result that negatively charged toner could be produced. Such negatively charged toner would disadvantageously be reversely transferred to the third and fourth photoconductor drums 51M and 51C. Therefore, the transfer biases for the third and fourth photoconductor drums 51M and 51C in the monochrome printing mode are made smaller than those in the color printing mode, so that the charge up can be prevented.

(3) the transfer bias for the photoconductor drum 51K for toner in black in the monochrome printing mode is made smaller than that in the color printing mode. More specifically, the electric potential of a non-exposed area on the surface of the photoconductor drum 51K for toner in black in the color printing mode in the present embodiment is made smaller than that in the monochrome printing mode whereas the electric potential of an exposed area on the surface of the photoconductor drum 51K in the color printing mode remains unchanged in the monochrome printing mode. In order to effectively transfer a toner image (developer image) onto the sheet P (medium), a transfer bias potential (e.g., −1000 V) equal to the electric potential of the exposed area may be applied. Therefore, the potential difference between the electric potential of the non-exposed area and the transfer bias potential in the monochrome printing mode may become smaller than that in the color printing mode, with the result that the electric current flowing therethrough can be reduced.

(4) when a front edge of a sheet P enters a nip position between the photoconductor drum 51K and the transfer roller 74K, the transfer current would become uneven between the portion in contact with the sheet P and the portion out of contact with the sheet P, and resultantly the surface potential of the photoconductor drum 51K would become uneven. Such unevenness of the surface potential would have some effect on the surface potential of the photoconductor drum 51K during the subsequent development operation, and the larger the transfer current, the more greatly this effect would become. In particular, in the present embodiment, the surface potential of the photoconductor drum 51K after charging in the monochrome printing mode is configured to be made smaller than that in the color printing mode. Therefore, the potential difference between the exposed area and the non-exposed area is relatively small and thus the effect produced when the front edge of a sheet P enters the nip position may be nonnegligible. In this respect, it is particularly preferable in the present embodiment that the transfer current in the monochrome printing mode be made smaller than that in the color printing mode so as to reduce the unevenness of the surface potential of the photoconductor 51K.

<Developing Bias Voltage Regulation Control>

The next discussion focuses on a developing bias voltage to be applied to each development roller 53, and more specifically on the developing bias voltage regulated under control of the controller 100 (the developing bias regulator 106 provided in the controller 100).

The developing bias voltage is a voltage to be applied to each development roller 53. The developing bias voltage is regulated in such a manner that an absolute value of a developing bias voltage applied to the development roller 53K in the monochrome printing mode is smaller than that in the color printing mode. For example, as shown in FIG. 5, the development bias voltage applied to the development roller 53K in the color printing mode is 450 V, while the development bias voltage applied to the development roller 53K in the monochrome printing mode is 300 V. As a result, the amount of toner transferred from the development roller 53K to the photoconductor drum 51K in the monochrome printing mode is made smaller than that in the color printing mode. The reason why the development bias voltage is lowered in the monochrome printing mode is that the more toner is put on a sheet P, the more likely the toner would be reversely transferred from the sheet P to the second and following photoconductor drums 51Y, 51M and 51C.

<Photoconductor Drum Surface Potential Regulation Control>

The next discussion focuses on a surface potential of each photoconductor drum 51 regulated by controlling the corresponding charger 52, and more specifically on the surface potential regulated under control of the controller 100 (the photoconductor potential regulator 108 provided in the controller 100).

The surface potential of each photoconductor drum 51 in the present embodiment is regulated by a voltage applied to the corresponding charger 52. As shown in FIG. 5, the surface potential of the photoconductor drum 51K is 700 V in the color printing mode and 550 V in the monochrome printing mode. The surface potential is regulated like this so that a thin line or a fine dot can be formed by toner put on a sufficient width, as will be readily understood from the description given below of the operation of the color printer 1. In the columns of the surface potential of photoconductor drum of FIG. 5, the values enclosed in parentheses indicate the surface potential after the exposure to light by the LED units 40.

<Operation>

Operation of the color printer 1 configured as described above will be described in detail.

[Operation in Color Printing Mode]

When the color printer 1 receives a piece of printing data for forming a color image, the color printer 1 operates in the color printing mode. To be more specific, the development rollers 53K, 53Y, 53M and 53C for toner in black, yellow, magenta and cyan are in contact with the corresponding photoconductor drums 51K, 51Y, 51M and 51C, respectively, as shown in FIG. 2. The surface of each photoconductor drum 51 is charged by the charger 52 at 700 V. Light regulated in accordance with the received piece of printing data is emitted to the surface of each photoconductor drum 51 so that an electrostatic latent image of a relatively low potential is formed on the surface of the photoconductor drum 51. Toner in each color is supplied to the corresponding photoconductor drum 51K, 51Y, 51M or 51C by the development roller 53K, 53Y, 53M or 53C located opposite to and in contact with the corresponding photoconductor drum 51K, 51Y, 51M or 51C, and a toner image in each color is formed on the surface of the corresponding photoconductor drum 51K, 51Y, 51M or 51C. During the operation for forming a toner image, a developing bias voltage of 450 V is applied to each development roller 53, and a sufficient amount of toner is transferred from the development roller 53 to the corresponding photoconductor drum 51 to form a toner image therewith. Thereafter, the toner image on the photoconductor drums 51K, 51Y, 51M and 51C are transferred onto a sheet P being transported. The transfer current in this operation is regulated under a constant-current regulating control scheme such that the transfer current applied to each transfer roller 74 exhibits the value as indicated in FIG. 4A.

Residual toner which has not been transferred from each photoconductor drum 51 to the sheet P still remains on the surface of the rotating photoconductor drum 51 while passing by the charger 52. The surface potential of the area of the photoconductor drum 51 having passed by the charger 52 is then increased to 700 V. Since the toner used in the present embodiment is of a positively chargeable type and likely to be transferred from a higher-potential point to a lower-potential point, the residual toner on the surface of the photoconductor drum 51 is collected by the development roller 53 when the residual toner comes in contact with the development roller 53.

The toner image transferred onto the sheet P is fixed on the sheet P in the fixing unit 80; thereafter, the sheet P passes through the sheet output unit 90 and is ejected onto the sheet output tray 4.

[Operation in Monochrome Printing Mode]

When the color printer 1 receives a piece of printing data for forming a monochrome image, the color printer 1 operates in the monochrome printing mode. To be more specific, the controller 100 sets its operation mode at the monochrome printing mode, and the separation mechanism control unit 102 of the controller 100 exercises control over the separation mechanism 110. The separation mechanism 110 operates under control of the separation mechanism control unit 102, and causes the development rollers 53Y, 53M and 53C for toner in colors of yellow, magenta and cyan to be located separate from the corresponding photoconductor drums 51Y, 51M and 51C, and the development roller 53K for toner in black to be located in contact with the corresponding photoconductor drum 51K, as shown in FIG. 2.

In the process cartridge 50K for toner in black, in contrast to the case of the color printing mode as described above, the surface of the photoconductor drum 51K is charged by the charger 52K at 550 V, and then exposed to light from the LED unit 40. Thereafter, a developing bias voltage of 300 V which is lower than that applied in the color printing mode is applied to the development roller 53K, to supply toner from the development roller 53K to the surface of the photoconductor drum 51K on which an electrostatic latent image is formed.

In this operation, the amount of toner supplied to the photoconductor drum 51K becomes smaller because the developing bias voltage of the development roller 53K is lowered to 300 V, and the amount of toner which would be reversely transferred to the photoconductor drums 51Y, 51M and 51C for toner in the colors other than black is resultantly reduced. However, if the surface potential of the photoconductor drum 51K were retained higher at 700 V while the developing bias voltage were lowered, a sufficient amount of toner could not be supplied enough to form a thin line or a small dot. This mechanism will now be described in detail with reference to FIG. 6.

Figure 6A:
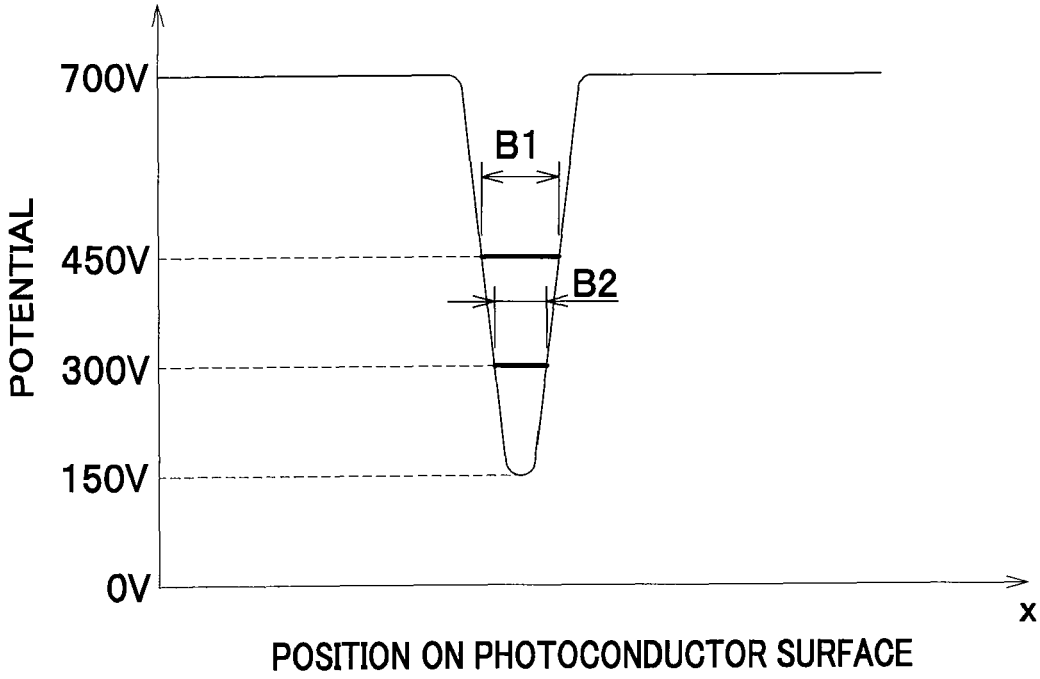
FIG. 6A is a graph showing a width of a toner image corresponding to a thin line of an electrostatic latent image formed on the photoconductor drum, as exhibited with a development bias voltage lowered and a surface potential of the photoconductor drum retained unchanged.
Figure 6B:
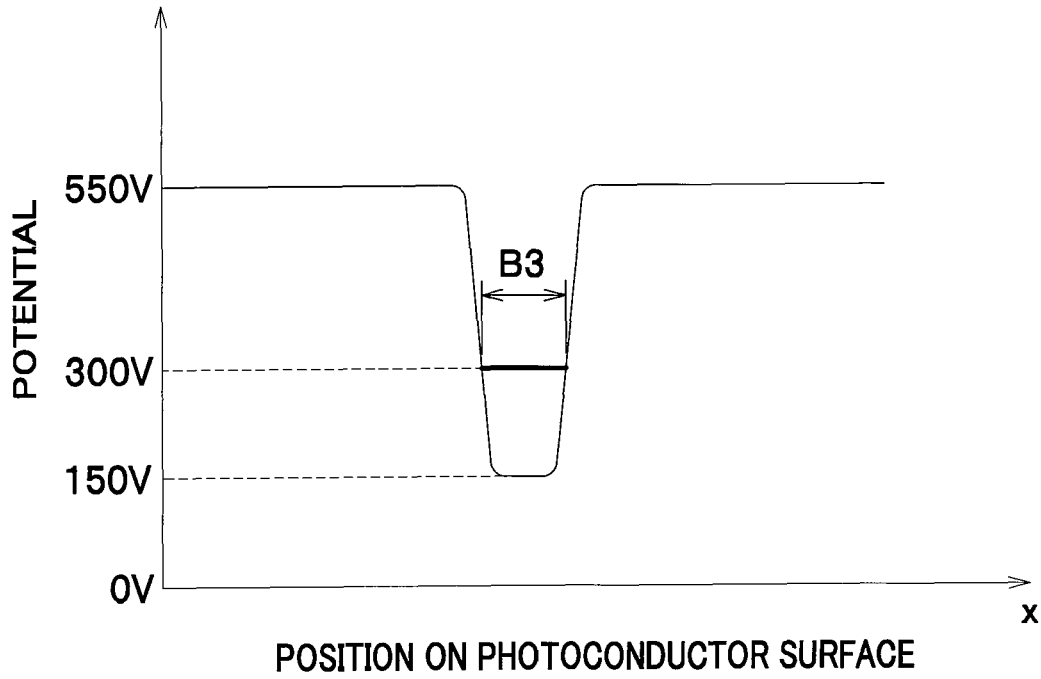
FIG. 6B is a graph showing a width of a toner image corresponding to a thin line of the electrostatic latent image formed on the photoconductor drum, as exhibited with the development bias voltage lowered and the surface potential of the photoconductor drum lowered.

FIGS. 6A and 6B represent the surface potential of the photoconductor drum 51K of which the surface is illuminated with light for an extremely short period of time, for example, to form a thin line. With the surface potential of the photoconductor drum 51K before exposure to light being set at 700 V and the developing bias voltage applied to the development roller 53K being set at 450 V (as to be regulated in the color printing mode in the present embodiment; see FIG. 5), toner is transferred to an area of the photoconductor drum 51K in which the potential is lowered to a value below 450 V, when the area of the photoconductor drum 51K comes in a position opposite to the development roller 53K. As a result, a thin line is formed with a width B1 as indicated at a level of 450 V in FIG. 6A. In contrast, if the developing bias voltage applied to the development roller 51 were set at 300 V with the surface potential of the photoconductor drum 51 before exposure to light being set at 700 V, toner would be transferred to an area of the photoconductor drum 51K in which the potential is lowered to a value below 300 V. A thin line formed as a result of these settings would have a width B2 as indicated at a level of 300 V in FIG. 6A. In other words, if the developing bias voltage were lowered to 300 V with the surface potential unchanged, the thin line formed would disadvantageously become thinner than a desired width.

On the other hand, if the surface potential of the photoconductor drum 51K is set at 550 V that is lower than the value in the color printing mode, with the developing bias voltage applied to the development roller 53K being lowered to 300 V, toner will be transferred to an area of the photoconductor drum 51K which can form a thin line having a width B3 as in FIG. 6B, that is, the width comparable to the width B1 as indicated at a level of 450 V in FIG. 6A.

Figure 7:
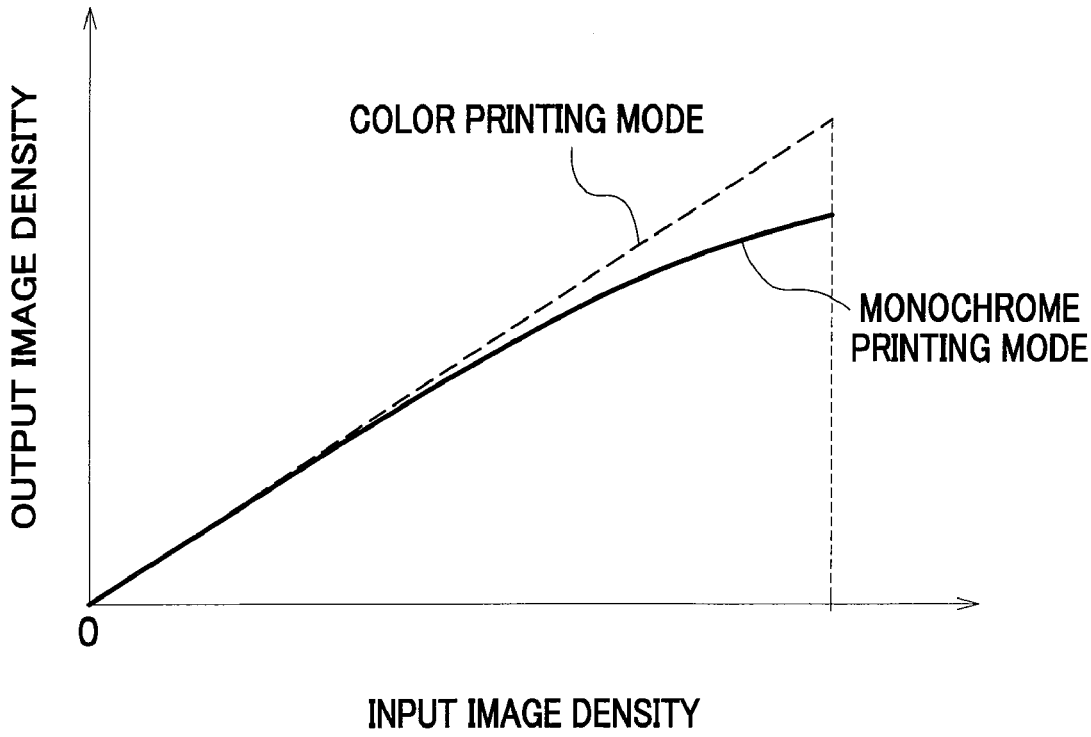
FIG. 7 is a graph showing output image density versus input image density curves, in a color printing mode and in a monochrome printing mode, as exhibited by carrying out one embodiment of the present invention.

The output image density of the color printer 1 according to the present embodiment will be described with reference to FIG. 7. In FIG. 7, the broken line indicates an output image density obtained in the color printing mode, and the solid line indicates an output image density obtained in the monochrome printing mode. As shown in FIG. 7, in the color printer 1 according to the present embodiment, an output image density in the monochrome printing mode is lower than that in the color printing mode when the input image density (the exposed-to-unexposed area ratio) is higher (i.e., the output image has a lot of solid fills). On the other hand, the output image density in the monochrome printing mode is comparable to that in the color printing mode when the input image density is lower (i.e., the output image has thin lines or fine dots or blank spaces). Accordingly, in the monochrome printing mode, the amount of toner supplied to an area which is higher in its input image density is made smaller so that the amount of toner which may be reversely transferred to the second and following photoconductor drums 51Y, 51M and 51C is reduced, whereas the output image density of an area which is lower in its input image density, such as that containing thin lines or fine dots, is high enough to obtain a clear and easy-to-see image. The reason why such an image density regulation as described above can serve to achieve the clear and easy-to-see image is that the apparent density of an output image depends, in the range of lower density, more on the light exposure area ratio, and in the range of higher density, more on the amount of toner.

Next discussion is directed to the operations of the process cartridges 50 other than the process cartridge for toner in black. In the process cartridges 50Y, 50M and 50C in the monochrome printing mode, the development rollers 53Y, 53M and 53C are separated from the corresponding photoconductor drums 51Y, 51M and 51C, and thus the residual toner on the surfaces of photoconductor drums 51Y, 51M and 51C are, unlike the case in the color printing mode, not collected by the development rollers 53Y, 53M and 53C. Therefore, when toner is reversely transferred from a sheet P to the photoconductor drums 51Y, 51M and 51C, the reversely transferred toner is placed again on the sheet P, which would possibly cause a ghost image on the sheet P.

In the color printer 1 according to the present embodiment, the developing biases applied between the photoconductor drums 51 and the corresponding transfer rollers 74 are regulated under a constant-current regulating control scheme such that the transfer current applied to each transfer roller 74 exhibits the value as indicated in FIG. 4B.

To be more specific, the transfer current applied to the transfer roller 74Y of the second process cartridge 50Y for toner in yellow located next to the process cartridge K for toner in black is regulated at 8 μA in the color printing mode, and at 20 μA in the monochrome printing mode. Accordingly, even if toner particles on the sheet P exhibits some variations in chargeability and contain particles which are less prone to being charged, such toner particles may be strongly attracted by the strong transfer bias applied between the photoconductor drum 51Y and the transfer roller 74Y in the process cartridge 50Y for toner in the second color (yellow). Consequently, the reverse transfer of toner from a sheet P to the photoconductor drum 51Y for toner in yellow can be reduced significantly.

For the third and following process cartridges 50M and 50C, the transfer current applied to the corresponding transfer rollers 74M and 74C are set smaller at 5 μA, and thus the excessive "charge up" of toner can be reduced. Consequently, the reverse transfer of negatively charged toner due to charging between toner particles can be reduced significantly.

As described above, in the color printer 1 according to the present embodiment, the transfer bias in the monochrome printing mode is regulated in such a manner that the transfer bias applied between the photoconductor drum 51Y ("adjacent" photoconductor drum that is located adjacently downstream of the photoconductor drum 51K) in the process cartridge 50Y and the corresponding transfer roller 74Y is larger than that applied therebetween in the color printing mode. Thus, toner is attracted toward a sheet P strongly in the process cartridge 50Y, so that the reverse transfer of toner can be effectively reduced. Furthermore, the developing bias voltage applied to the development roller 53K for toner in black is regulated in such a manner that the absolute value of the developing bias voltage in the monochrome printing mode is smaller than that in the color printing mode; thus, the amount of toner supplied to an area which is high in the input image density is reduced so that the reverse transfer of toner in the second and following process cartridges 50Y, 50M and 50C can be reduced. Moreover, the surface potential of the photoconductor drum 51K for toner in black is regulated in such a manner that the absolute value thereof in the monochrome printing mode is smaller than that in the color printing mode; thus, areas which are low in the input image density can be supplied with a sufficient amount of toner. Therefore, the good viewability of a fine pattern of thin lines, dots, etc. can be maintained.

Furthermore, in the color printer 1 according to the present embodiment, the transfer bias applied in the third or following process cartridges 50M and 50C is regulated in such a manner that the transfer bias applied in the monochrome printing mode is smaller than that applied in the color printing mode. Thus, the excessive "charge up" of toner can be prevented, and generation of toner with polarity opposite to the desired polarity (negatively charged toner in the present embodiment) can be suppressed, with the result that the reverse transfer of toner can be effectively reduced.

Although exemplary embodiment of the present invention has been described above, the present invention is not limited to the above-described embodiment, and various changes and modifications may be made thereto where appropriate. For example, the number of colors for use in the color printing mode may be five or more; that is, the number of photoconductor drums 51 provided may be five or more.

In the above-described embodiment, the color printer 1 is shown as one example of an image forming apparatus, but the image forming apparatus to which the present invention is applicable is not limited thereto; for example, the image forming apparatus consistent with the present invention may include a multi-function peripheral and a photocopier.

In the above-described embodiment, the transfer biases in the third and following process cartridges are regulated in such a manner that the transfer biases thereof applied in the monochrome printing mode are lower than those applied in the color printing mode. However, the present invention encompasses various other configurations in which the transfer biases applied in the color printing mode and those applied in the monochrome printing mode may be the same and in which those applied in the monochrome printing mode may be higher than those applied in the color printing mode.

In the above-described embodiment, the sheet P is illustrated by way of example of a medium to which developer is transferred from the surfaces of the photoconductor drums 51, but the medium may be an intermediate transfer belt.

What is claimed is:

1. An image forming apparatus operable in a plurality of operation modes including a monochrome printing mode and a color printing mode, the image forming apparatus comprising:

a first photoconductor drum for use at least in the monochrome printing mode;

a plurality of second photoconductor drums for use in the color printing mode;

a plurality of development rollers disposed in positions corresponding to the first and second photoconductor drums, each of the development rollers being configured to be in contact with and supply a corresponding photoconductor drum with developer and operative to collect developer remaining on the corresponding photoconductor drum in contact therewith during an operation thereof;

a separation mechanism configured to cause development rollers corresponding to the second photoconductor drums to move away from the corresponding second photoconductor drums and to come back to positions in which the development rollers are in contact with the corresponding second photoconductor drums;

a plurality of transfer members disposed in positions corresponding to the first and second photoconductor drums to transfer the developer from surfaces of the photoconductor drums to a medium being transported, wherein the second photoconductor drums are located downstream of the first photoconductor drum in a direction of transport of the medium; and a controller comprising:

a separation mechanism control unit configured to exercise control over the separation mechanism such that the development rollers corresponding to the second photoconductor drums are away from the corresponding second photoconductor drums in the monochrome printing mode, and a transfer bias regulator configured to regulate a transfer bias for each of the transfer members in such a manner that a transfer bias applied in the monochrome printing mode between a second photoconductor drum located adjacently downstream of the first photoconductor drum in the direction of transport of the medium and the corresponding transfer member is larger than that applied in the color printing mode.

2. The image forming apparatus according to claim 1, wherein the transfer bias regulator is further configured to regulate the transfer bias for each of the transfer members in such a manner that a transfer bias applied in the monochrome printing mode between a second photoconductor drum not located adjacent to the first photoconductor drum and the corresponding transfer member is smaller than that applied in the color printing mode.

3. The image forming apparatus according to claim 1, further comprising a plurality of chargers disposed in positions corresponding to the first and second photoconductor drums to electrically charge surfaces of the photoconductor drums, wherein the controller further comprises:

a developing bias regulator configured to regulate a developing bias for each of the development rollers in such a manner that an absolute value of a developing bias voltage applied to a development roller corresponding to the first photoconductor drum in the monochrome printing mode is smaller than that applied in the color printing mode, and a photoconductor potential regulator configured to regulate a surface potential of each of the photoconductor drums by controlling a corresponding charger in such a manner that an absolute value of the surface potential of the first photoconductor drum in the monochrome mode is smaller than that in the color printing mode.

4. An image forming apparatus operable in a plurality of operation modes including a monochrome printing mode and a color printing mode, the image forming apparatus comprising:

a first photoconductor drum for use at least in the monochrome printing mode;

a plurality of second photoconductor drums for use in the color printing mode;

a plurality of development rollers disposed in positions corresponding to the first and second photoconductor drums, each of the development rollers being configured to be in contact with and supply a corresponding photoconductor drum with developer and operative to collect developer remaining on the corresponding photoconductor drum in contact therewith during an operation thereof;

a plurality of chargers disposed in positions corresponding to the first and second photoconductor drums to electrically charge surfaces of the photoconductor drums;

a separation mechanism configured to cause development rollers corresponding to the second photoconductor drums to move away from the corresponding second photoconductor drums and to come back to the positions in which the development rollers are in contact with the corresponding second photoconductor drums;

a plurality of transfer members disposed in positions corresponding to the first and second photoconductor drums to transfer the developer from surfaces of the photoconductor drums to a medium being transported, wherein the second photoconductor drums are located downstream of the first photoconductor drum in a direction of transport of the medium; and a controller comprising:

a separation mechanism control unit configured to exercise control over the separation mechanism such that the development rollers corresponding to the second photoconductor drums are away from the corresponding second photoconductor drums in the monochrome printing mode, a developing bias regulator configured to regulate a developing bias for each of the development rollers in such a manner that an absolute value of a developing bias voltage applied to a development roller corresponding to the first photoconductor drum in the monochrome printing mode is smaller than that applied in the color printing mode, and a photoconductor potential regulator configured to regulate a surface potential of each of the photoconductor drums by controlling a corresponding charger in such a manner that an absolute value of the surface potential of the first photoconductor drum in the monochrome printing mode is smaller than that in the color printing mode.

5. The image forming apparatus according to claim 4, wherein the controller further comprises a transfer bias regulator configured to regulate a transfer bias for each of the transfer members in such a manner that a transfer bias applied in the monochrome printing mode between the first photoconductor drum and the corresponding transfer member is smaller than that applied in the color printing mode.

* * * * *